US011486383B2

(12) United States Patent
Kuhnert et al.

(10) Patent No.: US 11,486,383 B2
(45) Date of Patent: Nov. 1, 2022

(54) ORBITAL PUMP DEVICE COMPRISING CROWNING FOR DELIVERING LIQUID MEDIUM AS WELL AS METHOD AND USE

(71) Applicant: ebm-papst St. Georgen GmbH & Co. KG, St. Georgen (DE)

(72) Inventors: Gerhard Kuhnert, Villingen-Schwenningen (DE); Patrick Stengel, St. Georgen (DE); Lars Uebersohn, Villingen-Schwenningen (DE); Christian Dold, Villingen-Schwenningen (DE)

( * ) Notice: Subject to any disclaimer, the term of this patent is extended or adjusted under 35 U.S.C. 154(b) by 0 days.

(21) Appl. No.: 16/948,202

(22) Filed: Sep. 8, 2020

(65) Prior Publication Data

US 2021/0071657 A1 Mar. 11, 2021

(30) Foreign Application Priority Data

Sep. 6, 2019 (DE) ..... 102019213611.7

(51) Int. Cl.
*F04B 43/14* (2006.01)
*F04B 43/12* (2006.01)

(52) U.S. Cl.
CPC ..... *F04B 43/14* (2013.01); *F04B 43/123* (2013.01)

(58) Field of Classification Search
CPC ..... F04B 43/123; F04B 43/14; F04B 43/009; F04B 43/12; F04B 45/08; F04C 5/00; F01C 5/00; F01C 21/106
USPC ..... 418/75–82
See application file for complete search history.

(56) References Cited

U.S. PATENT DOCUMENTS 3,787,148 A * 1/1974 Kopf ..... F04B 43/1276 417/477.8
4,410,305 A * 10/1983 Shank ..... F01C 21/106 418/150
4,884,956 A * 12/1989 Fujitani ..... F04C 29/0035 418/15
5,222,884 A * 6/1993 Kapadia ..... F04C 18/3562 418/150
6,699,025 B1 * 3/2004 Van Der Sluis ..... F01C 21/106 418/150
7,104,769 B2 * 9/2006 Davis ..... B41J 2/17596 417/477.9
2016/0061198 A1 * 3/2016 Ishigaki ..... F04B 43/1261 417/477.2

(Continued)

*Primary Examiner* — Essama Omgba
*Assistant Examiner* — Dnyanesh G Kasture
(74) *Attorney, Agent, or Firm* — Weide & Miller, Ltd.

(57) ABSTRACT

In many pump types, in particular in orbital pumps, there is an optimization need with regard to the running characteristics, in particular with regard to parameters which relate to the delivery flow. What is provided is an orbital pump device for delivering liquid medium by a rotational movement including a hydraulic housing surrounding a hydraulic chamber in a fluid-tight manner at least one membrane unit which is arranged inside the hydraulic chamber in flat contact with an inner jacket surface of the hydraulic housing; and an inlet and an outlet provided in the hydraulic housing. At least one crowning is provided at the inner jacket surface and/or at the membrane unit such that a radial gap between the membrane unit and the inner jacket surface is defined by the crowning in a circumferential section of less than 360°, and in particular less than 180°.

10 Claims, 7 Drawing Sheets

(56) References Cited

U.S. PATENT DOCUMENTS

2016/0153450 A1* 6/2016 Bruck ..... F01N 3/2066
418/104

* cited by examiner

ORBITAL PUMP DEVICE COMPRISING CROWNING FOR DELIVERING LIQUID MEDIUM AS WELL AS METHOD AND USE

CROSS-REFERENCE TO RELATED APPLICATION

This application claims priority to German Patent Application No. DE102019213611.7 which was filed on Sep. 6, 2019, the contents of which are hereby incorporated by reference.

TECHNICAL FIELD

The disclosed embodiments relate to an orbital pump device for delivering liquid medium by means of a rotational movement. The embodiments in particular relate to an orbital pump device with particularly stable operating behavior, including a particularly constant volume flow. Last but not least, the embodiments also relate to a corresponding method as well as to the use of at least one crowning in the orbital pump device.

BACKGROUND

Pumps with rotational movement, in particular orbital pumps, are used for various purposes and can deliver liquids and/or gases, depending on the application. The use of orbital pumps lends itself for liquids.

Due to process variation effects and manufacturing tolerances, the delivery volume can often not be specified exactly, for the example the volume (volume flow) delivered per time unit varies within a comparatively large range. Based on this prior art, there is interest in an orbital pump with operating properties, which are as constant as possible, in particular constant delivery volume flow.

SUMMARY

It is the object to provide a device and a method, by means of which the operating behavior of orbital pumps can be optimized, in particular with regard to operating properties, which are as constant as possible, in particular with regard to delivery volume flow, which is as constant as possible and possibly also high. The object in particular lies in designing an orbital pump in such a way that the pump is efficient (good delivery property) and thereby has advantageous operating properties over a broad spectrum of operating parameters, in particular also in the case of advantageous side effects with regard to delivery volume flow, which is as constant as possible, and good tightness properties.

This object is solved by means of an orbital pump device described herein. The features of the exemplary embodiments described below can be combined with one another in any combination unless otherwise noted.

An orbital pump device is provided, which is set up to deliver liquid medium by means of a rotational movement, in particular by actuation of an eccentric. The orbital pump may include a hydraulic housing surrounding a hydraulic chamber in a fluid-tight manner; at least one membrane unit, which can be actuated for the pumping effect and which is arranged inside the hydraulic chamber in flat contact with an inner jacket surface of the hydraulic housing; an inlet, which is provided in the hydraulic housing and which provides a hydraulic connection to the hydraulic chamber in order to introduce the medium; and an outlet, which is provided in the hydraulic housing and via which the medium can be discharged from the hydraulic chamber.

According to one exemplary embodiment, it is proposed that at least one crowning is provided at the inner jacket surface and/or at the membrane unit in such a way that a radial gap between the membrane unit and the inner jacket surface is defined by means of the crowning in a circumferential section of less than 360°, in particular less than 180°.

This provides in particular a stabilizing effect with regard to the delivery volume and also further advantageous operating properties.

It has been shown that the deviations of desired dimensions or desired parameters in particular at the interface between hydraulic housing and membrane unit have a strong effect on fluctuations in the delivery volume (flow). The disclosed embodiments are based on the knowledge that due to a geometric measure at this interface, a stabilization with regard to predefined desired delivery volumes is possible with particularly good effect.

The disclosed embodiments are based in particular on the concept of providing an irregularity (deviation), which locally increases the volume, at circular geometries in the radial direction (circumferential section-related recess or cavity, respectively). This can preferably be realized by means of material recess or material removal at previously circular or cylindrical jacket surfaces, respectively, in particular locally, based on an inlet or outlet provided in the pump housing.

It has further been shown that a crowning at an interface between two curved, in particular cylindrical surfaces, has a particularly positive effect on the operating properties of the pump. The delivery volume flow can in particular be stabilized by means of an irregularly incorporated or provided buffer volume. The crowning is preferably provided either at the concave (according to standard in particular pipe-cylindrical) inner jacket surface of the housing or at the convex (according to standard in particular cylindrical) outer contour of the membrane unit.

In contrast to the currently tried technologies, a stabilization of the operating properties of the pump can take place according to the invention by means of a geometric measure, which is limited to a circumferential section, at the interface between membrane unit and housing.

Based on the concept according to the disclosed embodiments, in particular the following advantages can be realized: stabilization of the amount of the delivery volume or of the delivery volume flow, respectively; balancing or compensation, respectively, of diameter tolerances; effective buffering increase of the attainable draw-in volume; process stability; and good tightness in spite of comparatively large delivery rate.

The delivery properties (key word: delivery sickle) can thereby also be influenced in the further angular ranges of the circumferential contour via the extent of a volume increase or of a gap, respectively, in the corresponding angular range, in particular as a function of diameter ratios or as a function of the depth of a crowning or recess, respectively. Depending on the relative arrangement of the crowning, a good tightness effect can also be attained thereby.

A crowning is to thereby in particular be understood as a local deviation from the standard geometry at the interface between membrane unit and inner jacket surface of the housing, in particular with regard to a respective nominal diameter, in particular with regard to a cylindrical geometry or a geometry with a circular cross section, respectively. A crowning gives rise in a geometric manner to a gap-increasing effect over a partial region of the circumference. A crowning can thereby be negative (arrangement at the membrane unit, curvature to the inside to the center point of the hydraulic chamber), or can be positive (arrangement at the housing, curvature radially to the outside). The term "crowning" is thereby not limited to a specific geometry or a specific production method, or a specific material combination. In the narrower sense, the term "crowning" can refer to measures at metallic materials, but, in the present case, can also relate to corresponding measures at preferred materials of the membrane unit.

The term "fluid-tight" can thereby more specifically also be reduced to the meaning "liquid-tight".

The geometry of a crowning can thereby also be optimized individually for the respective application. For example, the crowning shrinks tangentially in a sickle-shaped manner and tapers tangentially. The circumferential position with regard to the inlet or outlet can likewise be selected individually.

The orbital pump device can further have a membrane support on the inside of the membrane unit as well as a bearing (needle bearing) and an eccentric. The pumping movement can be transferred, for example, from an/from the eccentric to the membrane unit. The membrane unit can comprise the components membrane support, bearing, and eccentric, or can alternatively be provided separately from these components.

According to an exemplary embodiment, the radial gap defined by the crowning is sickle-shaped, in particular shrinking tangentially and tapering tangentially. It has been shown that a sickle-shaped geometry of the crowning or of the gap, respectively, provides for a particularly good buffer effect. The tangential tapering also has an advantageous effect on the operating properties, in particular with regard to vibrations or impulses.

A tangentially shrinking and/or tangentially tapering design can thereby also be realized independently of the sickle geometry. It has been shown that a particularly advantageous operating behavior can be realized by means of such a steady transition from the standard region into the crowning region. The tangentially shrinking/tapering design can also be characterized, e.g., by a continuously changing curvature radius.

According to an exemplary embodiment, a compensation geometry (compensation cavity) with an increased volume is provided in circumferential sections by means of the crowning, in particular for the liquid medium. This promotes a particularly stable operating behavior.

According to an exemplary embodiment, the crowning has, halfway along the circumferential extension thereof, the largest radial depth. According to an exemplary embodiment, the crowning is designed symmetrically in the circumferential direction. In any case, this design also has an advantageous effect on the operating behavior.

According to an exemplary embodiment, the curvature radius of the crowning varies as a function of the circumferential position, in particular at a respective transition to the inner jacket surface. In other words, the curvature is not constant, but increases or decreases. This geometric measure can further optimize the operating behavior.

According to an exemplary embodiment, the crowning is formed along the entire longitudinal extension (direction in particular parallel to the axis of the eccentric) of the membrane unit. This provides a good effect.

According to an exemplary embodiment, the crowning defines a circumferential position-related maximum gap size, which, in terms of value, lies in the single-digit parts per thousand range with regard to the nominal diameter of the membrane unit or of the hydraulic chamber, for example in the range of 1 to 3 per thousand (thousandth). This range has turned out to be advantageous in particular with regard to a good compromise of effect of the crowning and deviation from the standard geometry.

According to an exemplary embodiment, the crowning is arranged in an arrangement in hydraulic communication with the inlet and/or with the outlet. This also provides for a systematic influencing not only of the running behavior, but also the power characteristic of the pump. An arrangement, in the case of which the relative position of the crowning interacts hydraulically with the inlet and in particular also influences the flow behavior or the flow rate, is to thereby be understood as being "in hydraulic communication". An arrangement of this type in particular comprises an overlap of the crowning in the circumferential direction.

According to an exemplary embodiment, the crowning extends, in the circumferential direction, starting at the inlet (or the perpendicular thereof, respectively, to the inner jacket surface) or to the outlet, in particular with a circumferential overlap of maximally 25% of the absolute circumferential extension of the crowning. An overlap can thereby also influence the level of the fluidic communication between crowning and inlet or outlet, so that the achieved effect can be adjusted, in particular the effect exerted on the liquid medium.

According to an exemplary embodiment, the crowning extends at a circumferential angle in the range of from 5 to 120°, in particular at least 40 to 80° in particular approx. 70°. The circumferential angle can be individually adapted to the respective individual case and in particular also as a function of the depth of the radial gap. If an overlap on the inlet or outlet side is desired, the circumferential angle can be comparatively large.

According to an exemplary embodiment, the interface (contact region) between the membrane unit and the inner jacket surface is divided into four circumferential sections of equal size, wherein the crowning extends in only one circumferential section or in/over maximally two adjacent circumferential sections. It has been shown that a local limitation of this type is advantageous for the arrangement of the crowning with regard to the effect of the crowning and with regard to the further operating parameters of the pump.

According to an exemplary embodiment, the crowning extends at least approximately over 90° circumferential angle+10° and thereby overlaps either the inlet or the outlet by 5 to 20° circumferential angle. This specified design (extension of the crowning essentially over % of the total circumference) has proven to be advantageous for many types of pumps.

According to an exemplary embodiment, the membrane unit is designed in a ring-shaped manner and is supported by means of a membrane support located on the inside, in particular by means of a ring-shaped membrane support, which surrounds one/the eccentric of the orbital pump device. In the case of many orbital pump types, this design has proven to be advantageous. In an arrangement of this type, the crowning has proven to be particularly advantageous or effective, respectively.

According to an exemplary embodiment, the inner jacket surface is designed in a pipe-cylindrical manner. According to this, the crowning represents a deviation from this pipe-cylindrical geometry, when provided at the inner jacket surface.

According to an exemplary embodiment, the ratio of the diameter of the crowning to the nominal diameter of the membrane unit or of the hydraulic chamber lies in the range of from 0.9 to 1.1 (ratio S1), in particular in the range of from 0.95 to 1.05. This level of a radial irregularity (maximally approx. 10%, in particular 0.1 to 5%) has proven to be advantageous.

According to an exemplary embodiment, the crowning is provided exclusively at the inner jacket surface (negative crowning). This can be advantageous, e.g., in the case of certain material combinations (membrane unit and inner jacket surface). In the alternative, the crowning can be provided exclusively at the membrane unit. This can be particularly advantageous, depending on the design of the housing and depending on the requirements in the individual case.

According to an exemplary embodiment, the crowning is provided exclusively in an arrangement in hydraulic communication with the inlet. The stabilizing effect of the crowning is thereby particularly noticeable. A buffering of diameter tolerances can thus in particular take place in a particularly effective way. The crowning thereby preferably overlaps the inlet opening completely.

The crowning is optionally provided exclusively in an arrangement in hydraulic communication with the outlet. A crowning exclusively at the outlet in particular also provides advantages with regard to optimized tightness. A largely constant sealing gap can in particular be ensured at the housing contour. The crowning thereby preferably overlaps the outlet opening completely.

The above-mentioned object is also solved by means of an orbital pump device for delivering liquid medium by means of a rotational movement, comprising a hydraulic housing surrounding a hydraulic chamber in a fluid-tight manner, comprising at least one membrane unit, which can be actuated for the pumping effect, and comprising an inlet and an outlet provided in the hydraulic housing; in particular an above-described orbital pump device, produced by designing at least one crowning at the inner jacket surface and/or at the membrane unit for defining a radial gap between the membrane unit and the inner jacket surface, in particular produced by means of crowning. This results in the above-mentioned advantages, in particular also an operational improvement of pumps by means of a comparatively simple, effective measure, which can be realized in a simple way at a plurality of different pump types. The crowning is used, for example, for metallic materials. The crowning can optionally also be used for other materials. The crowning is in particular carried out in a radial depth, which is larger than or equal to a tolerance range for the affected component, in particular larger than or equal to a cumulated tolerance range for the inner diameter of the hydraulic chamber and for the outer diameter of the membrane unit.

The above-mentioned object is also solved by means of a method for operating an orbital pump device for delivering liquid medium by means of a rotational movement, in particular by means of actuation of a membrane unit by means of an eccentric, in particular an above-described orbital pump device, wherein a relative movement of a/the membrane unit of the orbital pump device relative to an inner jacket surface of a hydraulic housing of the orbital pump device is controlled or regulated to deliver the liquid medium, wherein the membrane unit contacts the inner jacket surface; wherein the membrane unit is moved relative to at least one crowning, which is arranged at the interface between the membrane unit and the inner jacket surface and which is in hydraulic communication with the inlet and/or with the outlet, wherein the crowning defines a radial gap for receiving the liquid medium between the membrane unit and the inner jacket surface in a circumferential section of less than 360°, in particular less than 180°. This results in the above-mentioned advantages, in particular also during the operation of pumps. The operating behavior can be optimized. The membrane unit is in particular actuated and is moved relative to the housing in such a way that the radial gap is/remains useable as pump cavity for the medium.

The method can also comprise, for example, a regulating of the flow rate (delivery volume flow or delivered volume per time unit, respectively), in particular by means of speed regulation.

The above-mentioned object is also solved by means of the use of a crowning provided at the membrane unit or at the inner jacket surface of a hydraulic housing of an orbital pump device, for defining a radial gap in a circumferential section of less than 360°, in particular less than 180°, for receiving liquid medium to be delivered by means of the pumping movement between the membrane unit and the inner jacket surface, in particular in an above-described orbital pump device, in particular in the case of an above-described method. This results in the above-mentioned advantages.

BRIEF DESCRIPTION OF THE DRAWINGS

The disclosed embodiments will be described in more detail in the following figures, whereby, for reference numerals, which are not explicitly described in a respective drawing figure, reference is made to the other drawing figures. In particular, individual alternatives for the arrangement and design of a crowning of orbital pump are illustrated, in which:

FIG. 5 shows an exemplary arrangement of a crowning at a hydraulic housing of an orbital pump device according to exemplary embodiments in a perspective side view;

DETAILED DESCRIPTION OF EMBODIMENTS

Figure 1:
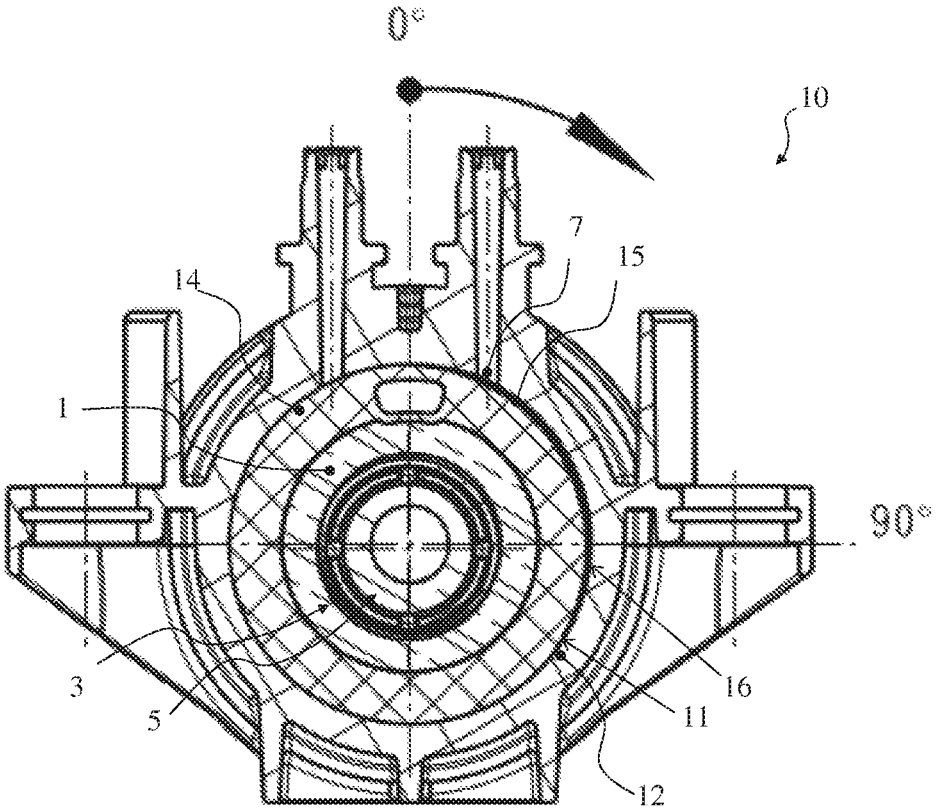
FIG. 1 shows an orbital pump device comprising a crowning according to an exemplary embodiment in a cut side view.

The figures are initially described jointly with reference to all reference numerals. Individual aspects are emphasized by reference to each of the figures.

An orbital pump device 10 comprises a hydraulic chamber 11 (nominal diameter D11), a hydraulic housing 12 comprising an inner jacket surface 13, and a membrane unit 14 (nominal diameter D14). A membrane support 1 is supported on a bearing 3, in particular needle bearing, and is actuated by an eccentric 5. The liquid to be pumped is delivered via an inlet 7 into the chamber 11 and is further pumped via an outlet 9.

A radial gap 16 between the membrane unit 14 and the inner jacket surface 13 is created by means of a crowning 15 (fictitious or mathematical diameter D15, respectively), in a circumferentially specific position. The crowning starts at a circumferential point A, and the crowning ends at a circumferential point C. The circumferential center point B of the crowning region is in particular the location with the deepest radial gap (gap size R15).

The crowning can be characterized in more detail, based on the following geometric characteristic numbers:

α circumferential angular position inlet or outlet, in particular with regard to the vertical (0°);

β circumferential angular position of the beginning of the crowning;

β0 transition region to the crowning;

β1 tapering region of the crowning or of the buffer sickle, respectively;

γ circumferential section of the crowning (buffer sickle);

δ standard region or default region, respectively (no crowning);

S1 ratio diameter crowning to nominal diameter hydraulic chamber or nominal diameter membrane unit; and S2 ratio nominal diameter hydraulic chamber to gap size or radial extension of the crowning, respectively.

The transition regions β0 or tapering region β1, respectively, of the crowning can be described as that region, in which a hydraulic effect already occurs due to the crowning, in particular with regard to the pressure. The transition region can in particular lie within the single-digit range, depending on the geometric design of the crowning, and depending on whether a circumferential overlap of the crowning with the inlet/outlet is at hand. The ratios S1, S2 can in each case characterize the crowning, but are not the only parameters, by means of which the crowning can be interpreted.

An orbital pump device 10 is shown in cross section in FIG. 1, with a viewing direction parallel to the axis of the eccentric. A crowning, which overlaps the inlet 7, is provided in an angular range of approx. 10° to approx. 125° (quadrant top right). Apart from this, the membrane unit 14 abuts on the inner jacket surface of the housing 12.

Figure 2:
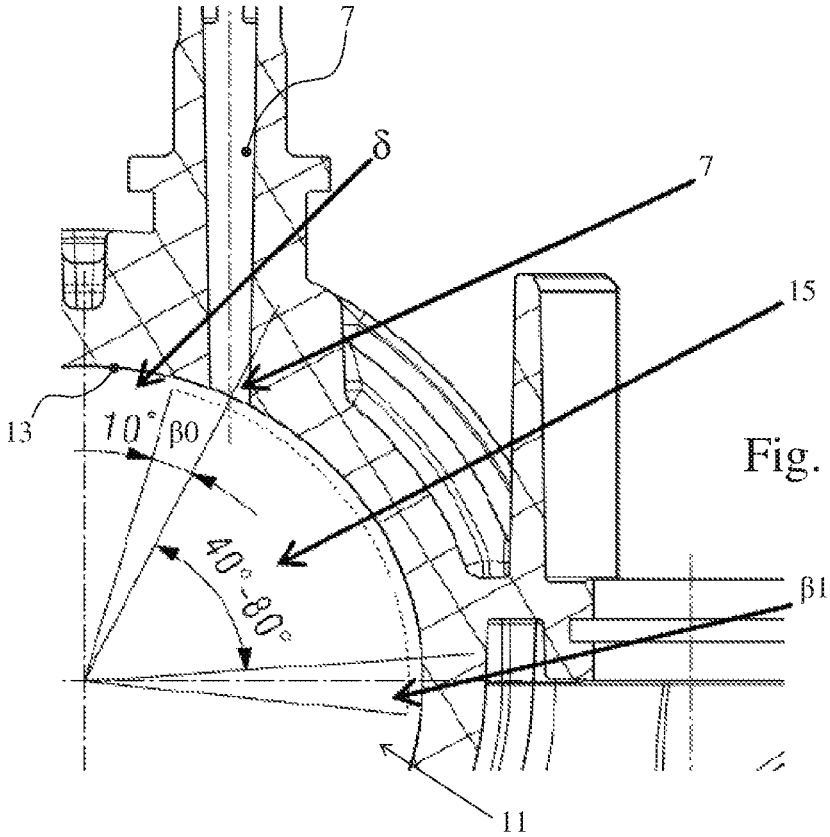
FIG. 2 and FIG. 5 show special geometric features of a crowning at a hydraulic housing of an orbital pump device according to exemplary embodiments, each in a cut side view.

A standard region δ (without radial gap) compared to a crowning 15 is shown in FIG. 2. The crowning 15 cannot be easily seen here, in particular because the membrane unit is not illustrated. The crowning 15 extends over a circumferential section of, e.g., 40 to 80°, and the respective transition region β0 and β1 in each case extends over approx. 10°.

Figure 3:
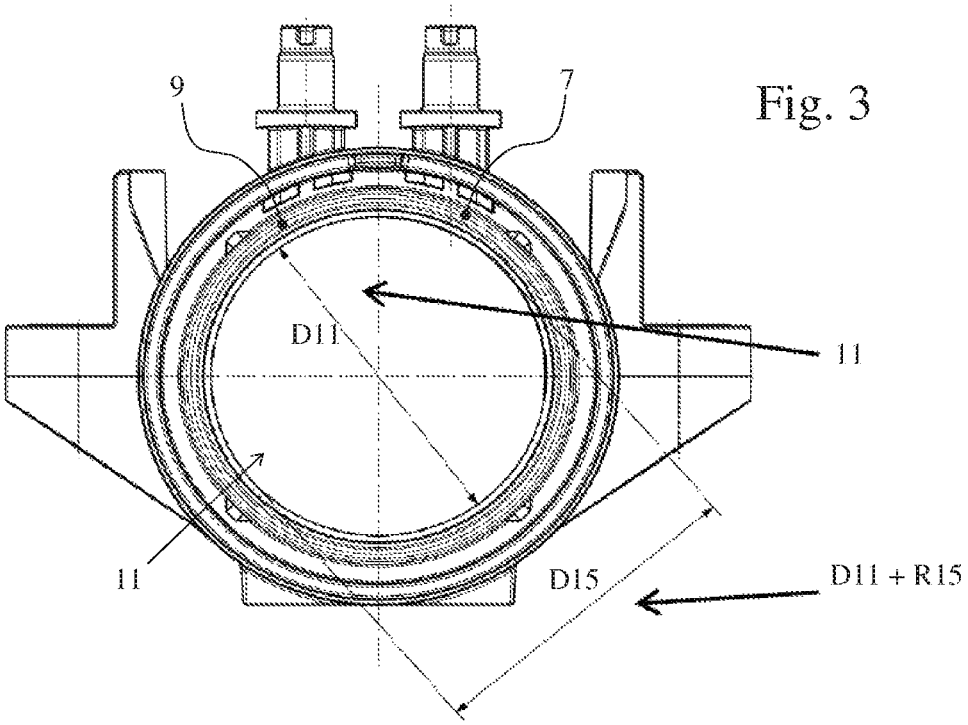
FIG. 3 shows exemplary diameter ratios of a crowning of an orbital pump device according to one of the exemplary embodiments in a cut side view.

The diameters D15 and D11 are described in more detail in FIG. 3. The crowning diameter D15 is the sum from the nominal diameter D11 of the chamber 11 and the radial depth R15 of the gap. A diameter ratio D15 to D11 (ratio S1) lies, for example, in the range of 1.002 (corresponding to approx. 2 per thousand crowning depth). Depending on the admissible tolerance, the gap size R15, however, can also be significantly larger, in particular up to 10% of the standard diameter of the chamber. A further ratio S2 can also be formed from the nominal diameter D11 of the hydraulic chamber and the gap size R15 (D11:R15).

Figure 4:
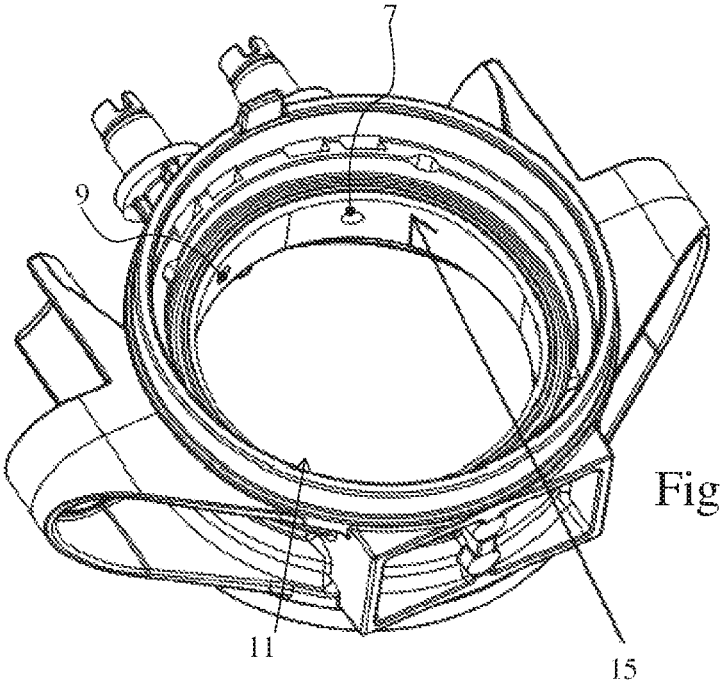
FIG. 4 shows an exemplary arrangement of a crowning at a hydraulic housing of an orbital pump device according to exemplary embodiments in a perspective side view.

An exemplary position of a crowning 15 provided at the inner jacket surface is identified in FIG. 4 in perspective view, namely in an overlapping arrangement with the inlet 7.

Figure 5:
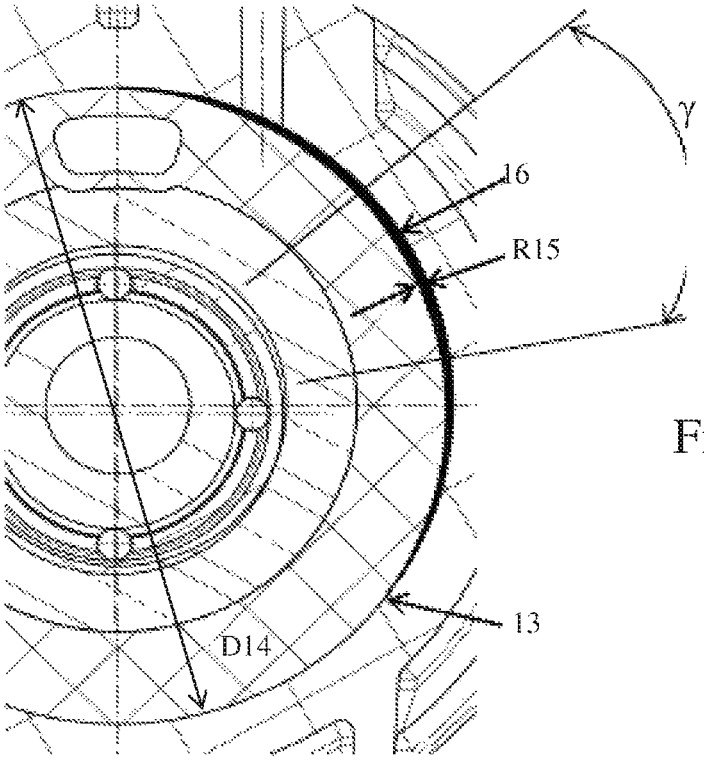

A comparatively long crowning 15 (extension ≥120°) is shown in FIG. 5, wherein the radial gap R15 is illustrated in a relatively excessively large manner. The crowning has a sickle-shaped geometry and overlaps the inlet region.

Figure 6:
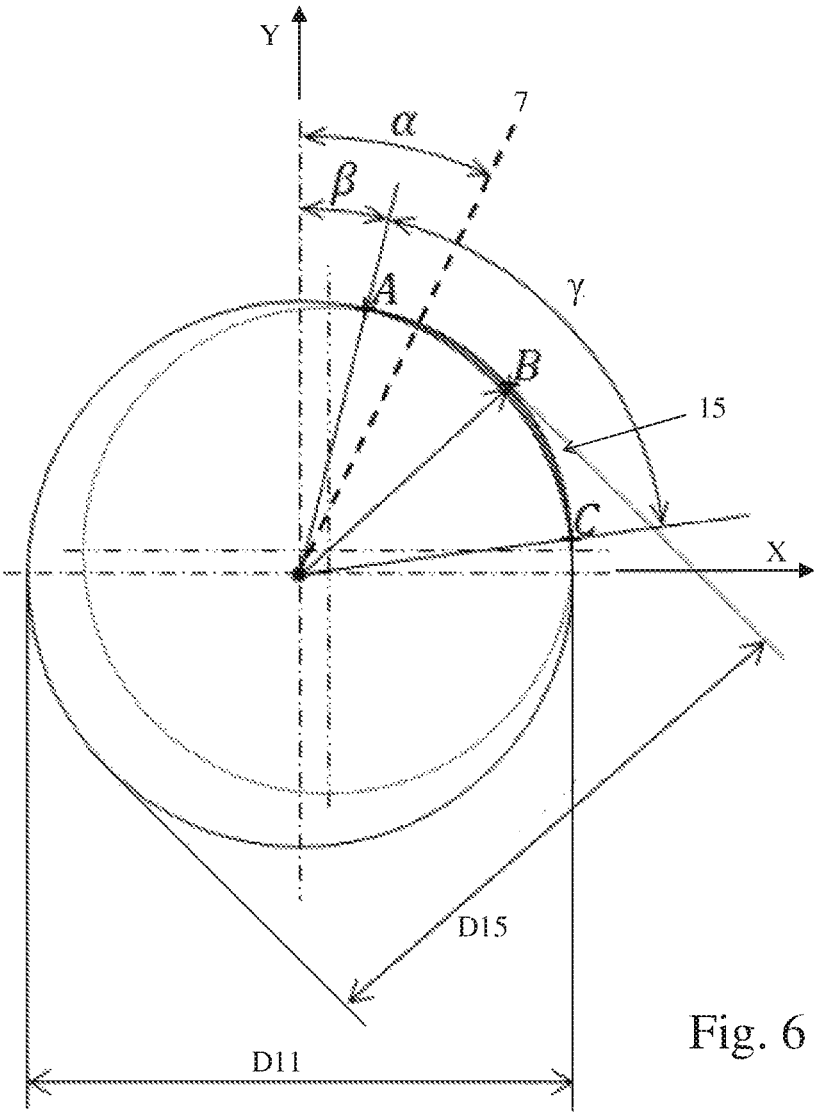
FIG. 6, FIG. 7, FIG. 8, and FIG. 9 show exemplary arrangements and designs of a crowning at a hydraulic housing or at the membrane unit in the case of an orbital pump device according to exemplary embodiments, each in schematic illustration.

One of the exemplary embodiments is described in more detail in FIG. 6. The crowning 15 is provided at the inner jacket surface 13 and starts in the region of the inlet (β≤α). The local gap increase is thereby ensured by a stronger (concave) curvature of the inner jacket surface (smaller curvature radius than standard diameter). The circumferential section γ of the crowning is approx. 70°. In the case of this and also in the case of the further exemplary embodiments, the circumferential position of the inlet 7 and the inner diameter of the housing can be selected or adapted individually, respectively.

Figure 7:
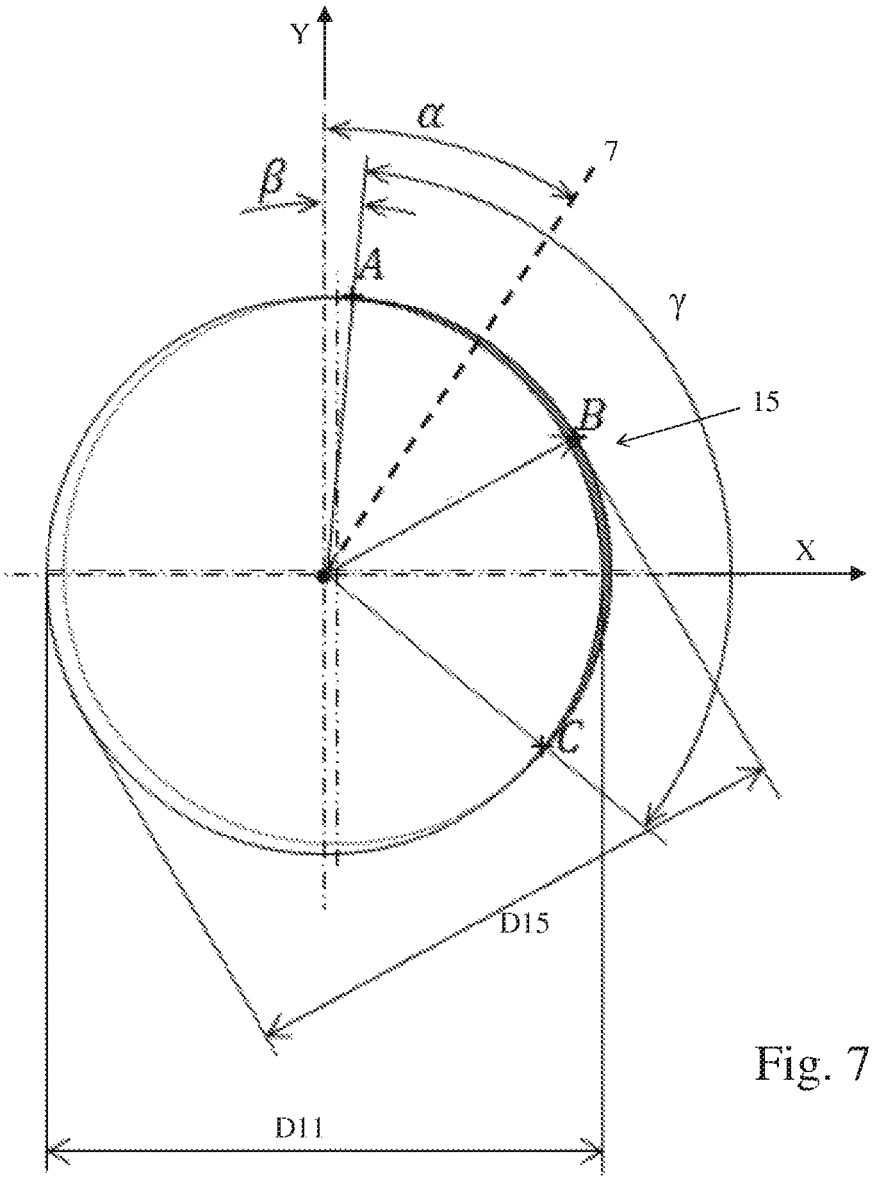

A comparatively long and deep crowning 15 is illustrated in FIG. 7. The crowning is provided at the inner jacket surface and starts in the region of the inlet, but with comparatively large overlap region (β−α≈20°). The circumferential section γ of the crowning is approx. 120°.

Figure 8:
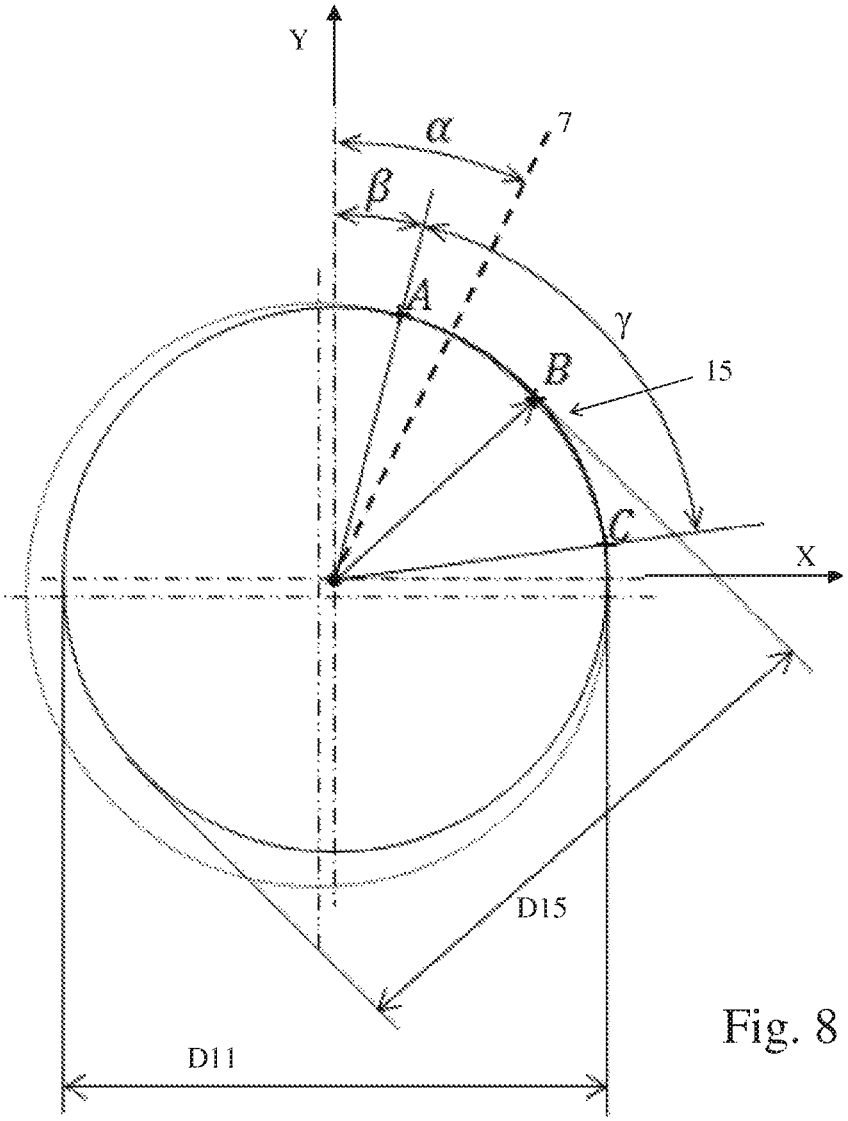

A comparatively weak crowning 15 is illustrated in FIG. 8. The crowning is provided at the membrane unit. The local gap increase is thereby ensured by means of a weaker (concave) curvature of the membrane unit (larger curvature radius than the standard sections of the outer jacket surface of the membrane unit). The circumferential section γ of the crowning is approx. 70°.

Figure 9:
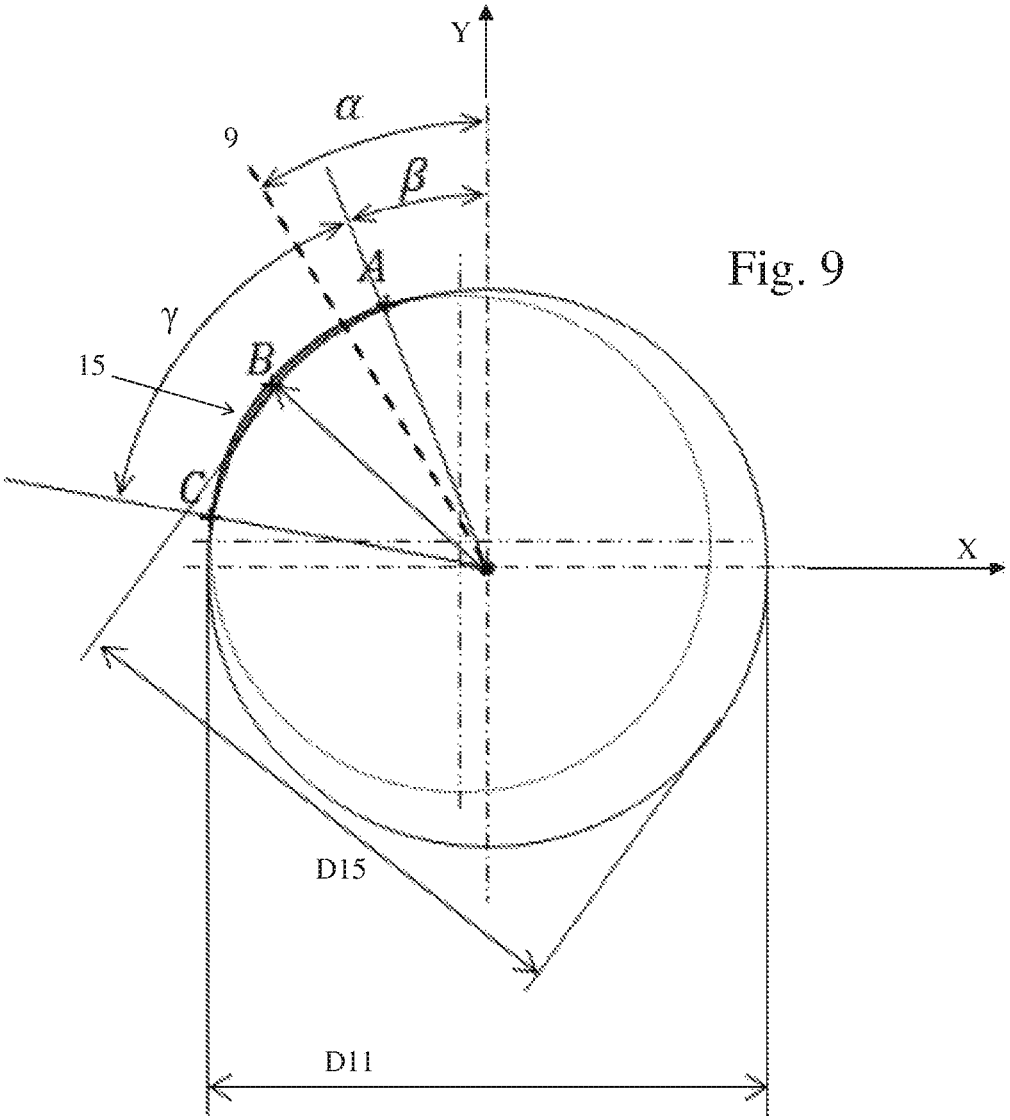

A crowning 15 is shown in FIG. 9, which is comparable to the crowning in FIG. 6, but which, in contrast, is arranged on the side of the outlet. The crowning can optionally be provided at the inner jacket surface or at the membrane unit (negative). The circumferential section γ of the crowning is approx. 70°.

In the case of the exemplary embodiments of FIGS. 6 to 9, the circumferential section can optionally also be varied in the range of from 5 to 120°. The crowning in each case overlaps the circumferential position of the inlet (β<α) or outlet, respectively (FIG. 9).

LIST OF REFERENCE NUMERALS

1 membrane support
3 bearing, in particular needle bearing
5 eccentric
7 inlet
9 outlet
10 orbital pump device
11 hydraulic chamber
12 hydraulic housing
13 inner jacket surface of the hydraulic housing
14 membrane unit
15 crowning
16 radial gap
A circumferential point beginning of the crowning
B center point of the crowning region, in particular largest gap
C circumferential point end of the crowning
D11 nominal diameter hydraulic chamber or inner jacket surface, respectively
D14 nominal diameter membrane unit (outer diameter)
D15 diameter crowning
R15 gap size
α circumferential angular position inlet or outlet, in particular with regard to the vertical (0°)
β circumferential angular position beginning of the crowning or circumferential section, respectively
β0 transition region to the crowning or to the circumferential section, respectively β1 tapering region of the crowning or of the buffer sickle, respectively γ circumferential section crowning or buffer region, respectively, or buffer sickle, respectively δ standard region or default region, respectively S1 ratio diameter crowning to nominal diameter hydraulic chamber or nominal diameter membrane unit S2 ratio nominal diameter hydraulic chamber to gap size or radial extension of the crowning, respectively

The invention claimed is:

1. An orbital pump device set up to deliver liquid medium by a rotational movement of an actuating eccentric, the orbital pump comprising:

a hydraulic housing surrounding a hydraulic chamber in a fluid-tight manner;

at least one membrane unit, which can be actuated to effect pumping and which is arranged inside the hydraulic chamber in flat contact with an inner jacket surface of the hydraulic housing;

an inlet, which is provided in the hydraulic housing and which provides a hydraulic connection to the hydraulic chamber in order to introduce the liquid medium;

an outlet, which is provided in the hydraulic housing and via which the liquid medium can be discharged from the hydraulic chamber;

wherein at least one crowning is provided at the inner jacket surface and/or at the membrane unit in such a way that a radial gap between the membrane unit and the inner jacket surface is defined by means of the at least one crowning in a circumferential section of less than 180°, further wherein the radial gap defined by the at least one crowning is sickle-shaped, shrinking tangentially and tapering tangentially; wherein a compensation geometry that increases a volume of the hydraulic chamber is provided in circumferential sections by means of the at least one crowning; wherein the at least one crowning has, halfway along the circumferential extension thereof, the largest radial depth; wherein the at least one crowning is symmetrical in the circumferential direction;

and wherein a size of the radial gap has a maximum value at a circumferential position on the inner jacket surface, and a ratio of the maximum value of the radial gap size to a nominal diameter of the membrane unit is in the range of 0.001-0.003.

2. The orbital pump device according to claim 1, wherein a curvature radius of the at least one crowning varies as a function of a circumferential position at a respective transition to the inner jacket surface.

3. The orbital pump device according to claim 1, wherein the at least one crowning is formed along an entire longitudinal extension of the membrane unit.

4. The orbital pump device according to claim 1, wherein the at least one crowning is arranged in an arrangement in hydraulic communication with the inlet and/or with the outlet; and wherein the at least one crowning extends, in the circumferential direction, starting at the inlet or extends to the outlet with a circumferential overlap of maximally 25% of an absolute circumferential extension of the crowning.

5. The orbital pump device according to claim 1, wherein the at least one crowning extends at a circumferential angle in a range from 5 to 120°; wherein an interface between the membrane unit and the inner jacket surface is divided into four circumferential sections of equal size, wherein the at least one crowning extends in only one circumferential section or in/over maximally two adjacent circumferential sections; and wherein the crowning extends at least over 90° circumferential angle to at most 100° and thereby overlaps either the inlet or the outlet by 5 to 20° circumferential angle.

6. The orbital pump device according to claim 1, wherein the membrane unit is ring-shaped and is supported by means of a membrane support located inside the membrane unit, which surrounds the eccentric of the orbital pump device; and wherein the inner jacket surface is cylindrical.

7. The orbital pump device according to claim 1, wherein the ratio of radial gap extent to the nominal radius of the membrane unit or of the hydraulic chamber lies in the range of from 0.9 to 1.1.

8. The orbital pump device according claim 1, wherein the at least one crowning is provided exclusively at the inner jacket surface; or wherein the crowning is provided exclusively at the membrane unit.

9. The orbital pump device according to claim 1, wherein the at least one crowning is provided exclusively in an arrangement in hydraulic communication with the inlet; or wherein the at least one crowning is provided exclusively in an arrangement in hydraulic communication with the outlet.

10. A method for operating an orbital pump device for delivering liquid medium by a rotational movement, by actuation of a membrane unit by an eccentric, the method comprising:

providing an orbital pump device comprising:

a hydraulic housing surrounding a hydraulic chamber in a fluid-tight manner;

at least one membrane unit, which can be actuated to effect pumping and which is arranged inside the hydraulic chamber in flat contact with an inner jacket surface of the hydraulic housing;

an inlet, which is provided in the hydraulic housing and which provides a hydraulic connection to the hydraulic chamber in order to introduce the liquid medium;

an outlet, which is provided in the hydraulic housing and via which the liquid medium can be discharged from the hydraulic chamber;

wherein at least one crowning is provided at the inner jacket surface and/or at the membrane unit in such a way that a radial gap between the membrane unit and the inner jacket surface is defined by means of the at least one crowning in a circumferential section of less than 180°;

further wherein the radial gap defined by the at least one crowning is sickle-shaped, shrinking tangentially and tapering tangentially; wherein a compensation geometry that increases a volume of the hydraulic chamber is provided in circumferential sections by means of the at least one crowning; wherein the at least one crowning has, halfway along the circumferential extension thereof, the largest radial depth; wherein the at least one crowning is symmetrical in the circumferential direction;

wherein a size of the radial gap has a maximum value at a circumferential position on the inner jacket surface, and a ratio of the maximum value of the radial gap size to a nominal diameter of the membrane unit is in the range of 0.001-0.003;

wherein a relative movement of the membrane unit of the orbital pump device relative to the inner jacket surface of the hydraulic housing of the orbital pump device is controlled or regulated to deliver the liquid medium, wherein the membrane unit contacts the inner jacket surface; and wherein the membrane unit is moved relative to at least one crowning which is arranged at an interface between the membrane unit and the inner jacket surface and which is in hydraulic communication with the inlet and/or with the outlet.

* * * * *